United States Patent [19]

Benedicto et al.

[11] 4,184,472

[45] Jan. 22, 1980

[54] METHOD AND APPARATUS FOR SLICING CRYSTALS

[75] Inventors: John S. J. Benedicto, Falls Church, Va.; Bruce E. Woodgate, Crofton; Frederick C. Hallberg, Wheaton, both of Md.

[73] Assignee: The United States of America as represented by the Administrator of the National Aeronautics and Space Administration, Washington, D.C.

[21] Appl. No.: 906,298

[22] Filed: May 15, 1978

[51] Int. Cl.[2] ..... B28D 1/32

[52] U.S. Cl. ..... 125/23 R; 51/235; 83/152; 83/870; 269/21

[58] Field of Search ..... 83/870, 152, 27; 51/235, 283; 125/13 R, 23 R; 269/21

[56] References Cited

U.S. PATENT DOCUMENTS

| | | | |
|---|---|---|---|
| 1,872,415 | 8/1932 | Growley | 51/283 |
| 2,597,180 | 5/1952 | Reaser | 51/235 UX |
| 3,901,423 | 8/1975 | Hillberry | 125/23 R |

FOREIGN PATENT DOCUMENTS

| | | | |
|---|---|---|---|
| 1,387,590 | 3/1975 | United Kingdom | 83/152 |

*Primary Examiner*—Harold D. Whitehead

*Attorney, Agent, or Firm*—Robert D. Marchant; John R. Manning; John O. Tresansky

[57] ABSTRACT

A crystal is sliced in a plane parallel to flat, opposed parallel end faces of the crystal. The end faces of the crystal are gripped by a pair of opposed, perforated platens of a pair of vacuum chambers, one of which is translatable relative to the other. A blade cuts the crystal through the desired plane. A spring biases one of the vacuum chambers away from the other vacuum chamber while both of the faces are gripped by the vacuum chambers and the blade is cleaving the crystal. Thereby, a sliced portion of the crystal gripped by one of the vacuum chambers is pulled away from the remainder of the crystal gripped by the second vacuum chamber when the crystal has been cleaved by the blade through the plane.

3 Claims, 4 Drawing Figures

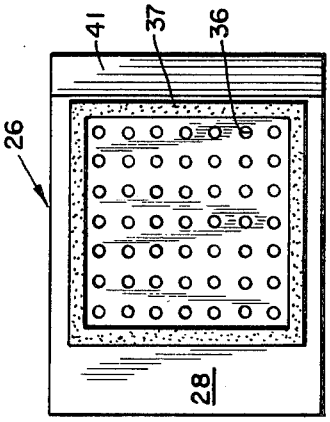
FIG. 3
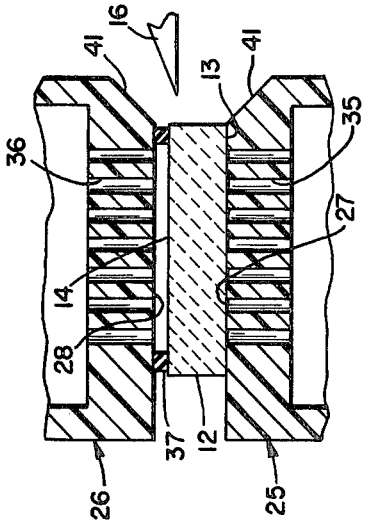
FIG. 4
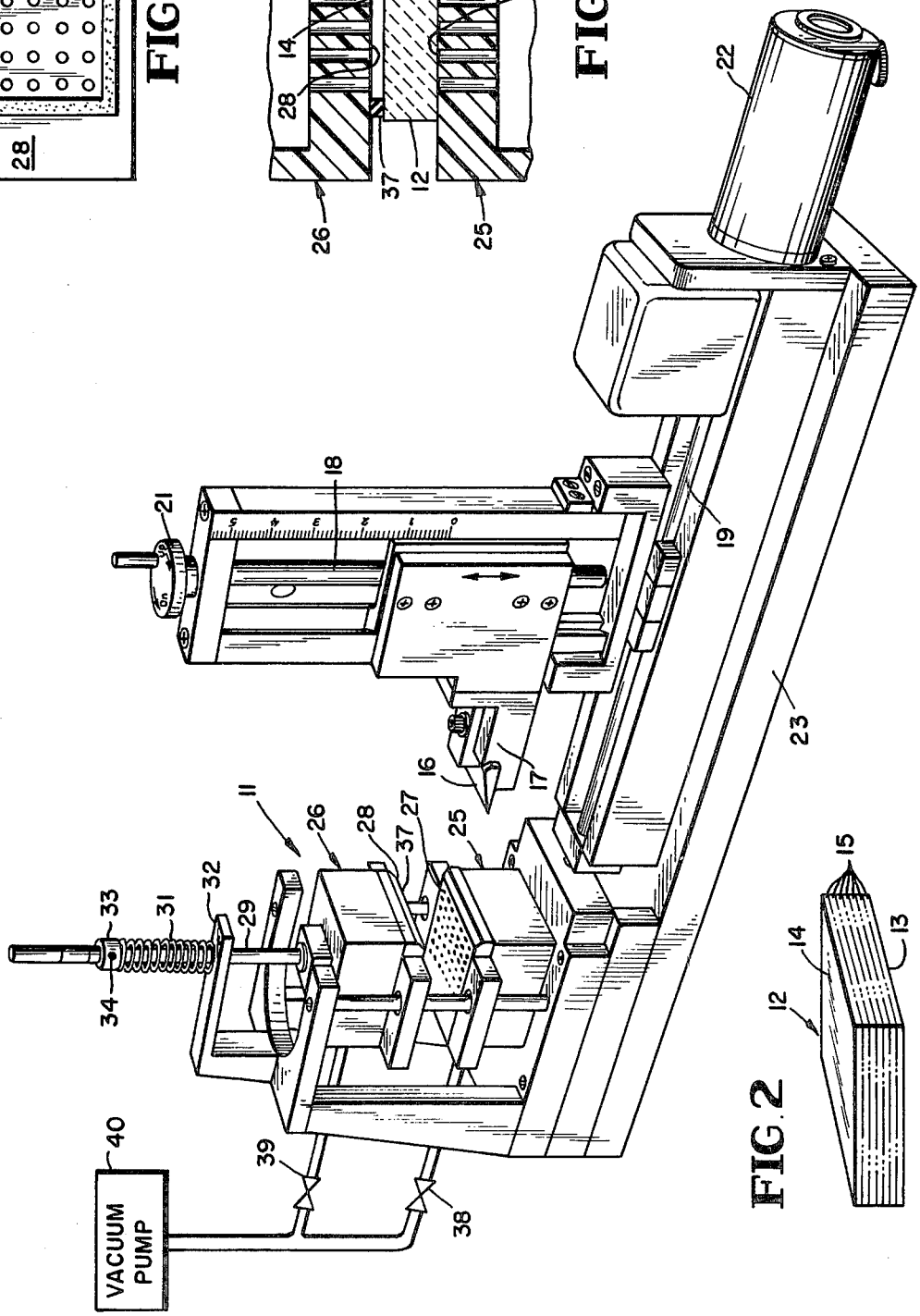
FIG. 1
FIG. 2

METHOD AND APPARATUS FOR SLICING CRYSTALS

ORIGIN OF THE INVENTION

The invention described herein was made by employees of the United States Government and may be manufactured and used by or for the Government for governmental purposes without the payment of any royalties thereon or therefor.

BRIEF SUMMARY OF THE INVENTION

The present invention relates generally to an apparatus for slicing a crystal, and more particularly, to such an apparatus wherein flat, opposed parallel end faces of the crystal are gripped and urged apart while the crystal is being cut through a plane parallel to the end faces.

Previously, relatively soft, KAP (potassium acid phthalate) and RAP (rubidium acid phthalate) crystals, as utilized in connection with X-ray spectrometers, have been cleaved by hand using a wire or sharp blade. When the crystals are cleaved by a wire they have a tendency to be scratched and it is often difficult to obtain crystals having uniform thickness. When the crystals are cut by sharp blades, such as razor blades, it is impossible to obtain very thin crystals, i.e., crystals having thicknesses on the order of 5 mils, a frequent requirement of KAP and RAP, soft crystals utilized in X-ray spectrometers. Both of the prior art, manual techniques were found to be slow and have a poor yield. While numerous machines have been developed to cut crystals and other objects in a precise manner, none apparently has been developed to precisely cut soft crystals, such as KAP and RAP crystals to thicknesses of 5 mils. A further problem is dealing with cleavable soft crystals, such as the RAP and KAP crystals, is that they are extremely fragile as they are formed of delicate materials. In consequence, handling these crystals by hand, particularly to cleave them to 5 mils, is extremely difficult and there is a high risk of such handling and cleaving leading to irreparable crystal damage.

In accordance with the present invention, a new and improved aparatus for cutting crystals, particularly soft RAP and KAP crystals, to thicknesses on the order of0.005 inches, includes bringing a blade into contact with an edge of the crystal, between a pair of opposed parallel faces of the crystal, while the opposed faces are being gripped and urged apart. Thereby, a sliced portion of the crystal is pulled away from the remainder of the crystal as the crystal is being cleaved by the blade through a plane where it is desired to make a slice. In a preferred embodiment, the flat, opposed, parallel end faces are gripped by first and second opposed, perforated plates of a pair of vacuum chambers. The use of a vacuum to grip the opposite faces of the crystal is particularly advantageous because of the delicate nature of the crystal and the very thin slices which are obtained from it. In addition, the vacuum facilitates release of the crystal slices and enables the force applied to the opposite faces of the crystal to be easily controlled, to prevent possible breakage of the crystal at points other than the desired cleavage plane.

The first plate is translatable relative to the second plate, with a spring urging the first plate away from the second plate while the plates grip the end faces. A holder for the crystal cutting blade is positioned to enable the crystal to be cut by the blade through each of the several planes. The holder position is variable so the cutting plane can be adjusted relative to the end faces to enable the crystal to be sliced through each of a plurality of desired planes. The blade intersection with the side of the crystal is precisely controlled, to within one mil, by connecting the blade holder to a pair of orthogonally mounted lead screws that respectively control the cutting plane of the blade and the blade position relative to the side of the crystal.

A further feature of the invention is that the perforated area of the translatable plate is bordered by a resilient cushion, formed, for example, of neoprene rubber. The cushion protects the crystal from damage when the opposed faces of the crystal are simultaneously gripped, and enables irregularities on the crystal face to be compensated, whereby there is increased suction and more uniform pull by the vacuum on the two faces of the crystal.

It is, accordingly, an object of the present invention to provide a new and improved apparatus for cutting crystals in a precise manner.

Another object of the invention is to provide a crystal cutting apparatus which enables crystals to be cut precisely to a thickness of 5 mils.

A further object of the invention is to provide a crystal cutting apparatus wherein crystals of uniform thickness are easily obtained, at relatively high speed and with high yield.

Another object of the invention is to provide a crystal cutting apparatus wherein the crystal is cut without scratches.

An additional object of the invention is to provide a crystal cutting apparatus wherein opposite, parallel end faces of the crystal are gripped and urged away from each other while the crystal is being cleaved by a cutting blade.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWINGS

FIG. 1 is a perspective, overall view of a preferred embodiment of the apparatus of the invention;

FIG. 2 is a perspective view of a crystal adapted to the cut by the apparatus of FIG. 1;

FIG. 3 is a top plan view of a plate included in a vacuum chamber for holding the crystal in situ, particularly showing a rubber cushion in contact with the crystal; and FIG. 4 is a side view in cross section, FIG. 1 specifically showing the crystal, a pair of plates for holding opposed faces of the crystal in situ, and a blade for cleaving the crystal in a plane between the faces gripped by the vacuum plates.

DESCRIPTION OF THE PREFERRED EMBODIMENTS

Reference is now made to FIG. 1 of the drawing wherein there is illustrated a station 11 for gripping a relatively soft mother crystal 12, such as a, KAP, or RAP crystal, having the shape of right parallelepiped, as illustrated in FIG. 2. Crystal 12 includes a pair of opposed, parallel faces 13 and 14 and is to be cleaved in a plurality of planes 15 parallel to faces 13 and 14. Crystal 12 is cleaved so that a plurality of very thin crystal slices, each typically having a thickness on the order of 5 mils, are formed.

The apparatus for cleaving crystal 12 through planes 15 includes microtome or blade 16 that is carried by a blade holder 17. Blade holder 17 is adapted to be vertically and horizontally translated by vertical and horizontal lead screws 18 and 19. Lead screw 18 is manually controlled by handle 21 so that the positon of the cutting edge of microtome 16 can be controlled very precisely, preferably to within one mil. Blade 16 and holder 17 are horizontally translated into a side wall of crystal 12, between faces 13 and 14, by driving the holder with lead screw 19, that is driven by motor 22. The entire mechanism including gripper 11, lead screws 18 and 19, holder 17, and motor 22, is stably mounted on a base plate 23.

Gripping station 11 includes lower and upper vacuum chambers 25 and 26 respectively having perforated, flat-faced platens 27 and 28 that respectively mate with and grip lower and upper faces 13 and 14 of crystal 12. Vacuum chamber 25 is fixedly mounted on base 23, while vacuum chamber 26 is vertically translatable relative to chamber 25, by virtue of the connection between chamber 26 and vertically extending rod 29. Rod 29 is biased upwardly by tension spring 31, so that chamber 26 and platen 28 have a tendency to be biased away from chamber 25 and platen 27. Opposite ends of tension spring 31 are connected to bracket 32, through which shaft 29 extends, and collar 33, the vertical position of which can be adjusted by set screw 34. Adjusting the vertical position of collar 33 changes the tension on spring 31 and therefore the force with which platen 28 has a tendency to pull face 14 of crystal 12 away from the remainder of the crystal when the crystal is cleaved by microtome 16.

As illustrated in FIGS. 3 and 4, platens 27 and 28 respectively include a matrix of relatively small diameter, vertical bores 35 and 36 that draw a vacuum on faces 13 and 14 of crystal 12. In one preferred embodiment, bores 35 and 36 are formed on ¼-inch centers by using a number 65 drill bit on platens 27 and 28. Surrounding the matrix of bores 36 is a border formed of a resilient, air impervious strip 37, preferably formed of neoprene rubber. The bottom face of strip 37 engages the top face 14 of crystal 12 so that the crystal does not bear directly against platen 28. The resilient, air confining strip 37 enables crystals having non-uniform top faces to be handled by the machine of the present invention without scratching the top surface, and enables any non-uniformity introduced on the top surface, during the cutting operations, to be compensated. Cushioning strip 37 also prevents chipping or cracking of crystal 12 because face 14 cannot contact platen 28, while enabling an increased force to be applied against face 14, resulting in a uniform pull on the face. The areas of the matrices in platens 27 and 28, as well as border 37, relative to the areas of faces 13 and 14, are such that all of the bores 35 are covered by bottom face 13 and all of bores 36 are in a chamber formed by the inner edge of strip 37 and top face 14 of crystal 12. A suitable vacuum, of a few pounds per square inch, is applied to faces 13 and 14 through bores 35 and 36, by virtue of chambers 25 and 26 being evacuated by vacuum pump 40. Chambers 25 and 26 are selectively connected to vacuum pump 40 and the atmosphere through valves 38 and 39, respectively. To enable microtome 16 to easily cleave crystal 12 in planes 15 and to reach the side of the crystal without any problems, chambers 25 and 26 include beveled faces 41 in proximity to the opposing faces of platens 27 and 28.

Crystal 12 is cut or cleved along planes 15 by the following procedures. Initially, valves 38 and 39 are adjusted so chambers 25 and 26 are connected to the atmosphere and crystal 12 is placed so that bottom face 13 thereof lies on platen 27, with one side wall of the crystal even with beveled edge 41 of chamber 25. If any bores 35 are not covered by face 13, it is necessary to cover the ends of the bores so that vacuum integrity is maintained. Similarly, if there are any bores 36 in platen 28 which are not within a vacuum chamber between upper face 14 of crystal 12 and the lower face of platen 28, these bores must be covered. When crystal 12 has been placed in the desired position on platen 27, valve 38 is adjusted so chamber 25 is evacuated by pump 40 and the crystal is held firmly in situ.

Holder 17 is horizontally translated by motor 22 and lead screw 19 so blade 16 is almost in contact with a side of crystal 12. The height of microtome 16 is then adjusted, by turning handle 21 so that lead screw 18 drives holder 17 vertically until the microtome edge is at the top face 14 of crystal 12. Of course, blade 16 was previously placed in holder 17 so that the edge of the blade is parallel to crystal cleaveage planes 15. A reading from a micrometer (not shown), associated with the lead screw 18 is recorded to indicate the starting height of microtome blade 16. After the height of blade 16 has been adjusted so that the blade edge is aligned with face 14, holder 17 is horizontally translated away from crystal 12 in response to motor 22 driving lead screw 19. Then, handle 21 is rotated so that the edge of blade 16 is lowered to the plane where the desired cleavage is to be made; typically, this is a distance of 5 mils.

Then, upper vacuum chamber 26 is lowered so that cushioned strip 37 abuts against top face 14 of crystal 12. The position of collar 33 is adjusted so that tension spring 31 exerts a desired force on chamber 26. Typically, for a crystal having a top face with rectangular dimensions of 1 inch by 2 inches, 600 to 800 grams of force are exerted by tension spring 31 on shaft 29 and chamber 26. Smaller crystals require a smaller lifting force while larger ones require a greater force. Excessive force exerted by spring 31 on shaft 29 and chamber 26 causes crystal 12 to be improperly cleaved along a cleavage plane that is not necessarily parallel to faces 13 and 14. After the force applied by spring 31 to chamber 26 has been properly adjusted, valve 39 is adjusted to connect pump 40 to the chamber 26 while the top face 14 of crystal 12 is being engaged by cushioned border 37. Top and bottom faces 13 and 14 of crystal 12 are at this time respectively gripped by vacuum platens 27 and 28. With crystal 12 gripped by vacuum platens 27 and 28 and the edge of microtome blade 16 vertically positioned for the desired thickness of the crystal to be cleaved, motor 22 is activated so that lead screw 19 advances holder 17 and microtome 16 toward crystal 12 at a slow speed that is regulated with conventional velocity feedback control apparatus.

In response to the edge of blade 16 contacting the wall of crystal 12 between faces 13 and 14, cleavage of the crystal occurs through a cleavage plane 15 that is parallel to faces 13 and 14. When cleavage occurs, the force exerted by spring 31 on rod 29 and chamber 26 causes the cleaved slice to be suddenly pulled away from the remainder of crystal 12, which remains in situ on platen 27. The cleaved crystal attached to platen 28 remains attached to platen 28 until the vacuum on chamber 26 is removed by adjusting valve 39 so that the chamber is connected to the atomosphere. When the vacuum on chamber 26 is released, the cleved crystal drops from platen 28 and is collected either manually or automatically.

The next wafer from crystal 12 is obtained in a similar way, by lowering chamber 26 so that platen 28 engages the newly formed planar top face of crystal 12. The newly formed top face of crystal 12 is again gripped by platen 28 by activating valve 39 so that vacuum pump 40 is connected to chamber 26. Then, blade 16 is lowered to the next desired cleavage plane, by turning handle 21 and reading the micrometer for lead screw 18. Microtome blade 16 and blade holder 17 are then advanced again by activating motor 22 so that it drives lead screw 19 and the crystal holder. The operation is continued as desired until the mother crystal has been sliced into the desired number of cleaved crystal slices having the desired thickness.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. Apparatus for slicing a soft crystal in a plane parallel to first and second flat opposed parallel end faces of said soft crystal comprising vacuum chamber means including a stationary platen having perforations therein for gripping said first flat end face of said soft crystal with vacuum, a moveable platen having perforations therein for gripping said second flat end face of said soft crystal with vacuum, said moveable platen being moveable substantially perpendicular to said plane, and spring means coupled to said moveable platen and applying a continuous force thereto substantially perpendicular to said plane and away from said stationary platen for applying stress forces to said soft crystal; a cleaving blade selectively moveable substantially perpendicular to and parallel to said plane; means for holding said cleaving blade at a position to enable said soft crystal to be cut by said cleaving blade through said plane; means for adjusting the position of said holding means so the cutting plane of said cleaving blade can be adjusted relative to the end faces; and means for driving said holding means so said cleaving blade is driven into contact with a side of said soft crystal in said cutting plane where said cleaving blade has been adjusted.

2. The apparatus of claim 1 wherein said moveable platen includes a resilient, air impervious strip bordering said perforations against which said first end face bears.

3. The apparatus of claim 1 wherein said stationary and moveable platens include beveled faces adjacent said perforations in proximity to said first and second end faces of said soft crystal for ease in moving said cleaving blade into contact with said soft crystal.

* * * * *